United States Patent [19]

Studenski

[11] Patent Number: 4,837,993

[45] Date of Patent: Jun. 13, 1989

[54] TEMPERED GLASS DOOR FITTING APPARATUS

[76] Inventor: Arnold H. Studenski, 1875 NE. 154th Ter., North Miami Beach, Fla. 33162

[21] Appl. No.: 240,718

[22] Filed: Sep. 6, 1988

[51] Int. Cl.[4] ..... E06B 3/60

[52] U.S. Cl. ..... 52/208; 52/766

[58] Field of Search ..... 52/398, 399, 127.8, 52/766, 764, 775, 208

[56] References Cited

U.S. PATENT DOCUMENTS

| | | | |
|---|---|---|---|
| 2,169,713 | 8/1939 | Stroud | 52/766 |
| 3,971,186 | 7/1976 | Havelka et al. . | |
| 4,423,582 | 1/1984 | Yates | 52/766 |
| 4,680,903 | 7/1987 | Horgan, Jr. . | |

*Primary Examiner*—John E. Murtagh

*Attorney, Agent, or Firm*—Henderson & Sturm

[57] ABSTRACT

A metal frame and glass panel structure has a metal shoe with a first channel on the bottom thereof and a second channel on the top thereof. A sheet of glass extends into the second top channel and has a resilient member between the bottom edge thereof and the bottom of the second channel. An elongated wedge-shaped member is provided on one side of the tempered glass panel and adjusting screws are provided for forcing the wedge-shaped member up towards a slanted wall in the second channel to thereby hold the tempered glass very tightly in the second channel. A stop structure is provided in the top of the elongated wedge-shaped member to abut a stop portion on a slanted wall in the second channel to thereby prevent too much force being applied against the bottom of the glass.

2 Claims, 2 Drawing Sheets

TEMPERED GLASS DOOR FITTING APPARATUS

TECHNICAL FIELD

The present invention relates generally to metal frame and glass structures and more particularly to a new glazing apparatus for such structures.

BACKGROUND ART

Tempered glass doors and side lights are used in many office and commercial buildings. They are generally installed in a metal frame using one of a variety of bonding agents. The installation of glass in such conventional frame arrangements requires costly set-ups and fixturesand considerable skill to proprly set and bond the tempered glass in place.

As an alternative to the aforementioned manner of installing tempered glass in glass doors, mechanical systems for accomplishing this result have been suggested, for example as shown in U.S. Pat. Nos. 4,423,582 to Yates and 4,680,903 to Horgan. Despite these attempts to solve the problem, the result has been structures which have no stop mechanism whereby consequently the wedge can be drawn so tightly that it will break the tempered glass or, in the alternative where a stop structure has been provided, the resultant structure is too complicated to be practical.

DISCLOSURE OF THE INVENTION

The present invention relates generally to a metal frame and glass panel structure having a metal shoe with a first channel on the bottom thereof and a second channel on the top thereof. A sheet of glass extends into the second top channel and has a resilient member between the bottom edge thereof and the bottom of the second channel. An elongated wedge-shaped member is provided on one side of the tempered glass panel and adjusting screws are provided for forcing the wedge-shaped member up towards a slanted wall in the second channel to thereby hold the tempered glass very tightly in the second channel. A stop structure is provided in the top of the elongated wedge-shaped member to abut a stop portion on a slanted wall in the second channel to thereby prevent too much force being applied against the bottom of the glass.

An object of the present invention is to provide an improved metal frame and glass panel structure.

Another object of the present invention is to provide a metal frame and glass panel structure which is essentially fool-proof.

A still further object of the present invention is to provide a metal frame and glass panel structure of the aforementioned type which has a stop structure thereon to prevent an excessive pressure of the wedge-shaped member from being applied against the bottom of the glass panel.

A still further object of the present invention is to provide a metal frame and glass panel structure which is simple and easy to install and yet which is dependable in its use.

Other objects, advantages, and novel features of the present invention will become apparent from the following detailed description of the invention when considered in conjunction with the accompanying drawings.

BEST MODE FOR CARRYING OUT THE INVENTION

Figure 1:
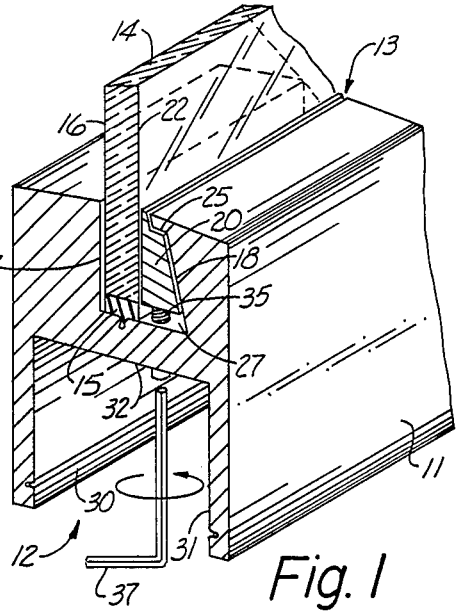
FIG. 1 is a perspective view in cross section of a preferred embodiment of the present invention.
Figure 2:
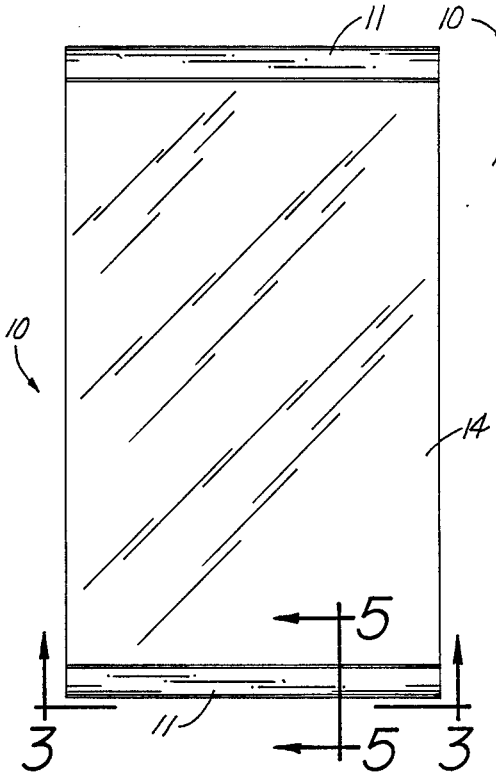
FIG. 2 is a side elevational view of a metal frame and glass panel structure constructed in accordance with the present invention.
Figure 3:
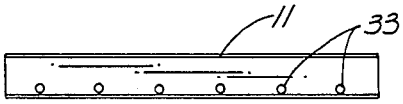
FIG. 3 is a bottom view taken along line 3—3 of FIG. 2.

Referring now to the drawings wherein like reference numerals designate identical or corresponding parts throughout the several views, FIG. 1 shows a metal frame and glass panel structure (10) constructed in accordance with the present invention and having a metal shoe (11) with a first channel (12) on the bottom thereof and a second channel (13) on the top thereof.

A sheet (14) of tempered glass extends down in the channel (13) and rests on a strip of rubber or other resilient material (15). One edge (16) of the glass (14) abuts the vertical wall (17) of the second channel (13).

An elongated wedge-shaped member (20) has a wall (21) in abutment with wall (22) of the sheet (14) of glass and a slanted wall (23) which engages the slanted wall (18) of the channel (13). A stop portion (24) is provided to engage a stop portion (25) on the top of the channel (13) and an elongated protuberance (26) extends between the top of the channel and the side (22) of the glass (14).

The lower or first channel (12) has a first and second vertical wall (30) and (31) and a horizontal wall (32). A plurality of openings (33) extend through the horizontal wall (32) and up into the upper channel through horizontal wall (27).

Of course it will be understood that the wedge-shaped member (20) is either slid into the end of the upper channel (13) after the glass (14) is in place or as an alternative method it can be placed in the upper channel before the set screws (35) are threadably engaged through threaded opening (36).

Figure 5:
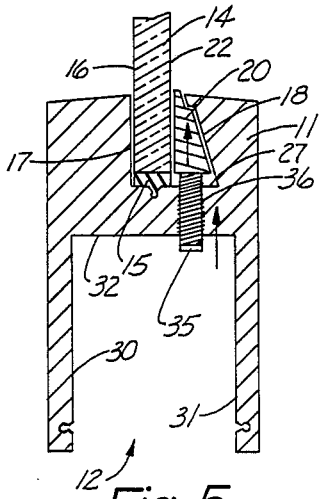
FIG. 5 is a cross sectional view taken along 5—5 of FIG. 2.
Figure 4:
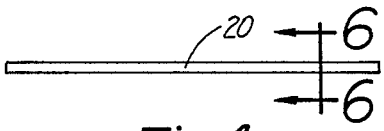
FIG. 4 is a side elevational view of the elongated wedge-shaped member.
Figure 6:
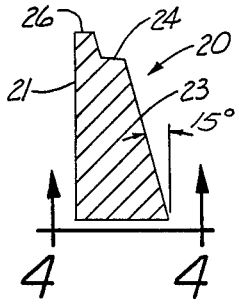
FIG. 6 is a cross sectional view of the elongated wedge-shaped member taken along line 6—6 of FIG. 4.
Figure 7:
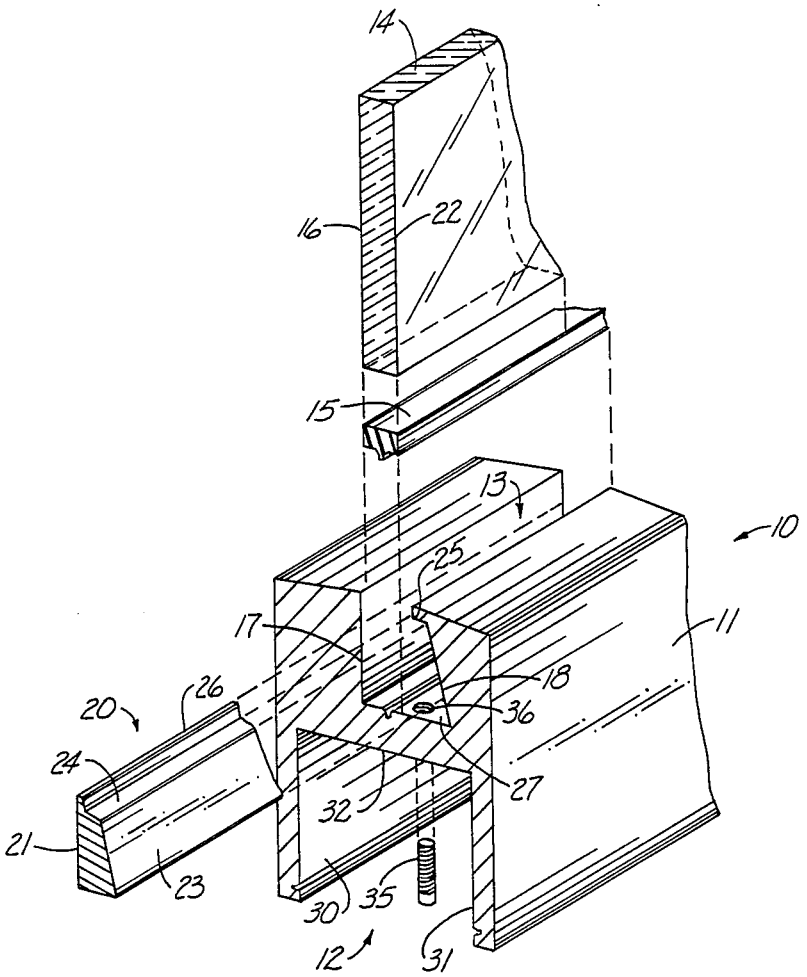
FIG. 7 is a perspective exploded view of the apparatus similar to that shown in FIG. 1.

Once all of the structures shown in FIG. 1 are in place, then an Allen wrench (37) is utilized to turn the set screw (35) and cause it to move upwardly against the bottom of the elongated wedge-shaped member (20). This will force the wedge-shaped member to the left as shown in FIG. 5 against the side of the glass (14) as it is pushed upwardly. Once the shelf (24) abuts the top portion (25) of the channel (13), the wedge-shaped member (20) will not move upwardly any more, thereby preventing too much pressure to be exerted against the glass (14). A set screw (35) goes through eacy of the openings (33).

Accordingly it will be appreciated that the preferred embodiment (10) shown herein does indeed accomplish the aforementioned objects. Obviously, many modifications and variations of the present invention are possible in light of the above teachings. For example, the shoe

(11) on the top of structure (10) as shown in FIG. 1 is merely an upside down version of the shoe (11) on the bottom of the structure (10) of FIG. 1. It is therefore to be understood that, within the scope of the appended claims, the invention may be practiced otherwise than as specifically described.

I claim:

1. a metal frame and glass panel structure comprising:

a metal shoe;

means for forming a first channel in one side of said metal shoe, said first channel having a first horizontal wall and a first and a second generally vertical wall disposed on each side of said horizontal wall respectively;

means for forming a second channel in the opposite side of said metal shoe from said one side, said second channel having a second horizontal wall, a third generally vertical wall on one side thereof and a slanted wall extending away from said second horizontal wall and toward said third generally vertical wall;

a sheet of glass having a portion thereof extending into said second channel, said portion of said sheet of glass having an edge adjacent to said second horizontal wall, one generally vertical wall which lies alongside said third generally vertical wall and another generally vertical wall;

resilient strip means disposed between and in abutment with said edge of the sheet of glass and the second horizontal wall;

an elongated wedge-shaped member disposed in said second channel, a generally vertical sidewall of said wedge-shaped member being in abutment with said other generally vertical wall of said sheet of glass and a generally non-vertical sidewall opposite to said gnerally vertical sidewall of said elongated wedge in abutment with the slanted wall of said second channel forming means;

a threaded opening extending through said shoe between the first and second horizontal wall; and threaded means threadably extending through said threaded opening for abutment with the wedge-shaped member for selectively engaging one end of said wedge-shaped member and forcing the wedge-shaped member toward said slanted wall of the second channel and thereby holding said portion of the sheet of glass against said second generally vertical wall.

2. The panel structure of claim 1 including stop means on the other end of said wedge-shaped member and on the end of said fourth wall opposite to where the slanted wall meets the second horizontal wall for stopping the wedge-shaped member from being forced beyond a predetermined position with respect to the means for forming the second channel.

* * * * *